US007014437B2

(12) United States Patent
Ohsumimoto et al.

(10) Patent No.: US 7,014,437 B2
(45) Date of Patent: Mar. 21, 2006

(54) SCREW COMPRESSOR

(75) Inventors: Hiroki Ohsumimoto, Kodaira (JP); Masayuki Urashin, Shizuoka (JP); Shigekazu Nozawa, Shizuoka (JP); Takeshi Hida, Shizuoka (JP); Hirotaka Kameya, Tsuchiura (JP)

(73) Assignee: Hitachi, Ltd., trustee, for the benefit of Hitachi Air Conditioning Systems Co., Ltd., Tokyo (JP)

( * ) Notice: Subject to any disclaimer, the term of this patent is extended or adjusted under 35 U.S.C. 154(b) by 0 days.

(21) Appl. No.: 10/765,059

(22) Filed: Jan. 28, 2004

(65) Prior Publication Data

US 2004/0208771 A1 Oct. 21, 2004

(30) Foreign Application Priority Data

Jan. 31, 2003 (JP) ..... 2003-022974

(51) Int. Cl.
*F01C 1/16* (2006.01)

(52) U.S. Cl. ..... 418/201.1; 418/DIG. 1; 55/459.1; 55/423; 55/467; 55/DIG. 17

(58) Field of Classification Search ..... 418/201.1, 418/DIG. 1; 55/459.1, 423, 467, DIG. 17
See application file for complete search history.

(56) References Cited

U.S. PATENT DOCUMENTS

| | | | | |
|---|---|---|---|---|
| 6,506,039 | B1 * | 1/2003 | Osumimoto et al. | 418/201.1 |
| 6,554,595 | B1 * | 4/2003 | Hida et al. | 418/201.1 |

FOREIGN PATENT DOCUMENTS

| | | | |
|---|---|---|---|
| DE | 641877 | A * | 2/1937 |
| JP | 54162220 | A * | 12/1979 |
| JP | 55117092 | A * | 9/1980 |
| JP | 04132891 | A * | 5/1992 |
| JP | 04153596 | A * | 5/1992 |
| JP | A-2002-138980 | | 5/2002 |

* cited by examiner

*Primary Examiner*—Theresa Trieu
(74) *Attorney, Agent, or Firm*—Antonelli, Terry, Stout and Kraus, LLP.

(57) ABSTRACT

An oil separator and an oil reservoir are formed integral with a main casing. Also, an opening communicated with the oil reservoir is formed in a part of a lower portion of an oil separation space of the oil separator. Preferably, the opening is formed so that its width is increased as it approaches an outer peripheral side of the oil separation space from a center thereof. Further, a safety valve is installed so that a line connecting between the safety valve and the center of the oil separator is made substantially in parallel to axes of screw rotors.

6 Claims, 3 Drawing Sheets

SCREW COMPRESSOR

BACKGROUND OF THE INVENTION

The present invention relates to a screw compressor including a substantially cylindrical-shaped, vertical oil separator and an oil reservoir that accumulates an oil separated by the oil separator, and more particular, is suitable for a screw compressor that is used in a refrigerating cycle and reduces an oil flow-off quantity of the compressor (a quantity of oil flowing outside the compressor).

A screw compressor for use in, for example, a refrigerating cycle comprises a casing accommodating therein at least a pair of male and female rotors meshing with each other and bearings, a discharge casing including bearings supporting the male and female rotors, a substantially cylindrical-shaped, vertical oil separator, and an oil reservoir accumulating an oil separated by the oil separator.

Substantially cylindrical-shaped, vertical oil separators include a centrifugal-type oil separator, in which centrifugal forces induced by a swirling flow in a separation space adhere an oil to an inner wall surface and the oil revolves along the inner wall of the separator to descend and is accumulated in an oil reservoir (oil reserving space) provided in a lower portion of the separator. Further, the separator is generally structured so that gas is discharged from an upper portion of the separation space. As an example to separate and recover an oil contained in gas discharged from a compression mechanism part of a compressor by the centrifugal separation action, there is a separation system called a cyclone type disclosed in, for example, JP-A-2002-138980. This conventional example is constructed such that discharge gas of the compressor is introduced into a cyclone type oil separating chamber provided in an upper portion of an oil tank, the oil is primary separated by utilizing a centrifugal force, and then, as a measure of preventing the oil from being again scattered, minute oil mist is secondary separated by a mesh wire pad or the like.

As described in the JP-A-2002-138980, it is general in centrifugal separation type oil separators that a separation space and an oil reserving space are constructed to unite together.

As described above, while it is general in centrifugal separation type oil separators that a separation space and an oil reserving space are constructed to unite together, a distance (spatial distance above an oil surface) between an oil surface of an oil in an oil reservoir and a compressed gas discharge pipe inlet mounted in an upper portion of the oil separator must be made large in order to ensure a high separation efficiency, so that it is difficult to make the separator small in size.

On the other hand, in trying to make an oil separator small in size, the spatial distance above an oil surface must be reduced in order to ensure a necessary holding oil quantity, and in the case where the distance is made small, the oil is flung up from the oil surface when the gas flows into the discharge pipe, whereby there is caused a problem of a remarkable increase in oil flow-off quantity.

Also, as illustrated in the JP-A-2002-138980, it is general that an oil separator is constructed to unite with a discharge casing of a compressor. In overhauling the compressor, the work is performed with the discharge casing removed, but since the discharge casing is heavy, there is caused a problem that workability is worsened. Further, according to specifications, compressors are bound to mount thereon a safety device such as a safety valve, etc. but when a safety valve is mounted on a compressor, there is involved a disadvantage that a floor space occupied by the compressor is increased.

It is an object of the invention to provide a screw compressor that is simple in construction, can be made small in size, and can improve the workability at the time of overhaul operation.

It is another object of the invention to provide a screw compressor that can also reduce an oil flow-off quantity of the compressor (a quantity of oil flowing outside the compressor) while achieving miniaturization.

It is a further object of the invention to provide a screw compressor that can reduce a discharge casing in weight and can be made compact even when a safety device is mounted on the compressor.

BRIEF SUMMARY OF THE INVENTION

In order to attain the above objects, the invention provides a screw compressor comprising a casing accommodating therein at least a pair of male and female rotors meshing with each other and bearings, a discharge casing including bearings supporting the male and female rotors, a substantially cylindrical-shaped, vertical oil separator, and an oil reservoir accumulating an oil separated by the oil separator, and wherein the oil separator and the oil reservoir are formed integral with the casing.

It is preferable that an inner space in the oil separator and the oil reservoir be communicated with each other by at least one or more openings. Also, it is preferable that the opening(s) be provided at a lower end of the oil separator or in the vicinity of the lower end. Further, it is preferable that the opening(s) be formed so that a width of the opening(s) is increased toward an outer periphery of an inner space of the oil separator from a center thereof (an area of the opening or openings is gradually increased).

In a screw compressor mounting thereon a safety valve communicated with a compressor discharge gas passage, it is preferable that the safety valve be mounted on an outer wall of the oil separator and a line connecting between the safety valve and a center of the oil separator is made substantially in parallel to axes of the screw rotors.

The invention also provides a screw compressor comprising a main casing accommodating therein a pair of male and female rotors that mesh with each other, bearings, and the like, a discharge casing including bearings that support the rotors, an oil separator, and an oil reservoir that accumulates an oil separated by the oil separator, and wherein the oil separator and the oil reservoir are formed integral with the main casing, an inner space in the oil separator and the oil reservoir are communicated with each other by at least one or more openings, a safety valve is mounted on the oil separator, and a line connecting between the safety valve and a center of the oil separator is made substantially in parallel to axes of the screw rotors.

Preferably, the opening(s) is formed in a part of a lower portion of an oil separation space of the oil separator and toward an outer peripheral side of the oil separation space from a center thereof.

DETAILED DESCRIPTION OF THE INVENTION

An embodiment of the invention will be described hereinafter with reference to the drawings.

Figure 1:
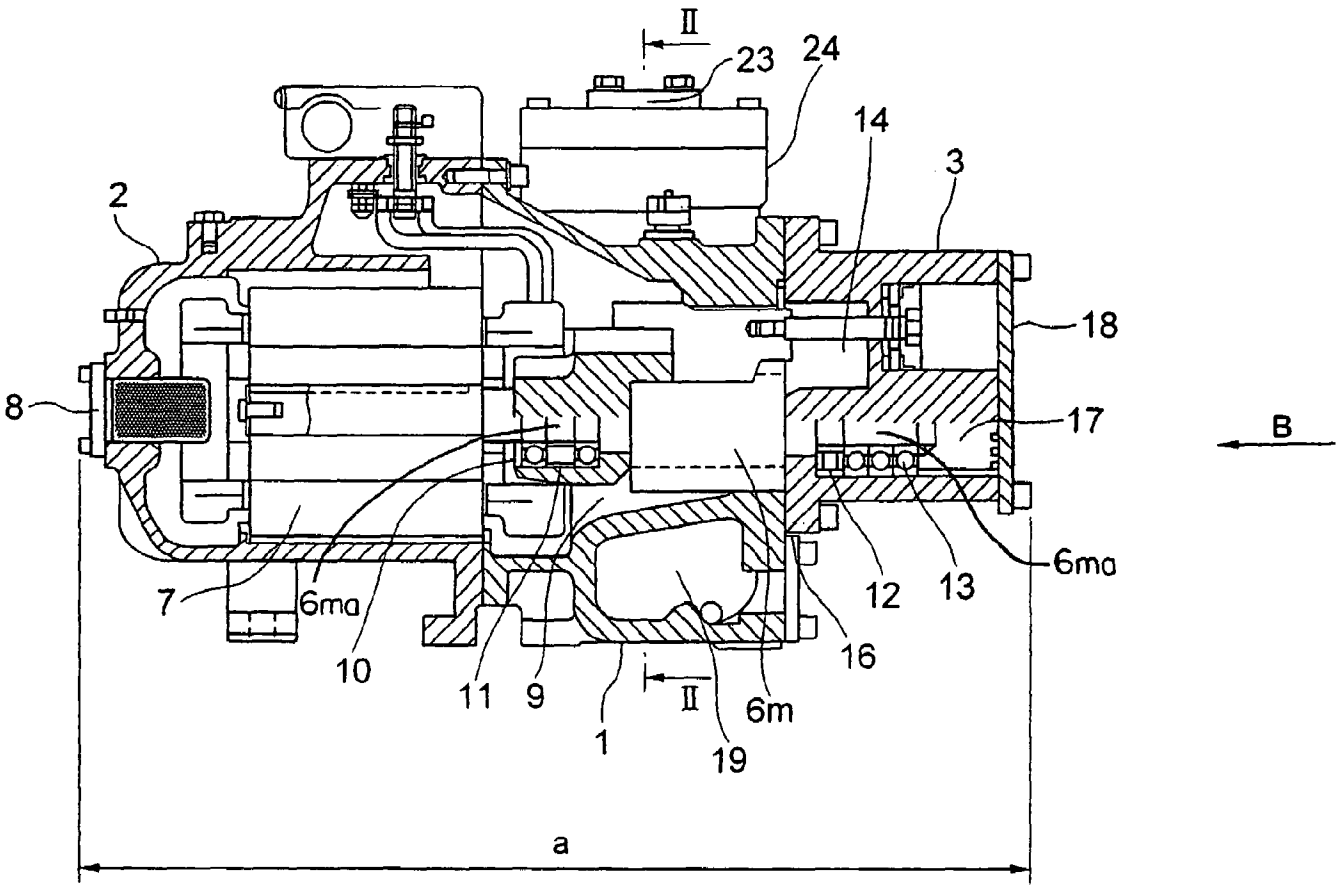
FIG. 1 is a longitudinal, cross sectional view showing a screw compressor according to an embodiment of the invention.
Figure 2:
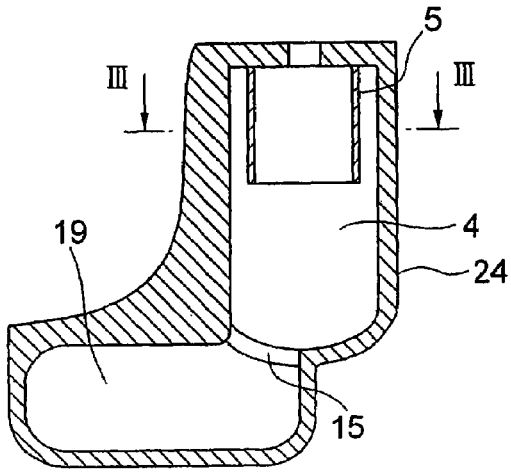
FIG. 2 is a cross sectional view showing an oil separator and an oil reservoir and taken along line II—II in FIG. 1.
Figure 3:
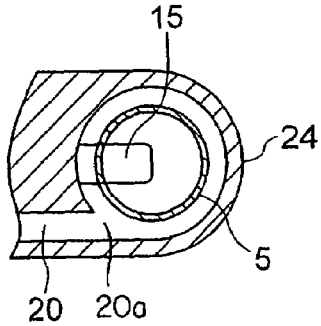
FIG. 3 is a cross sectional view taken along line III—III in FIG. 2.

FIG. 1 is a longitudinal, cross sectional view showing a screw compressor according to an embodiment of the invention, FIG. 2 is a cross sectional view taken along line II—II in FIG. 1 and showing details of an oil separator and an oil reservoir, and FIG. 3 is a cross sectional view taken along line III—III in FIG. 2.

The screw compressor comprises a casing (main casing) 1 accommodating therein at least a pair of male and female rotors 6*m*, 6*f*, roller bearings 10, 11, etc., a motor casing 2 having a suction inlet 8 and accommodating therein a drive motor 7, and a discharge casing 3 including a roller bearing 12, a ball bearing 13, etc. that support the male and female rotors 6*m*, 6*f*. The casings 1, 2, 3 are mutually connected in a sealing relationship. The main casing 1 is integrally formed with an oil separator 24 and an oil reservoir (oil reserving space) 19 on a back side or a front side, and an interior of the oil separator 24 constitutes an oil separation space 4 (see FIG. 2). Also, an opening 15 communicated with the oil reserving space 19 is formed in a lower portion of the oil separation space 4. Further, the main casing 1 is formed with a cylindrical-shaped bore 16 and a suction port 9, through which gas is introduced into the cylindrical-shaped bore 16. Accommodated in the cylindrical-shaped bore 16 are the pair of male and female rotors 6*m*, 6*f* rotatably supported by the roller bearings 10, 11, 12 and the ball bearing 13 to mesh with each other, and a shaft of either of the male and female rotors is connected directly to the drive motor 7 accommodated in the motor casing 2.

The discharge casing 3 accommodating therein the roller bearing 12 and the ball bearing 13 is fixed to the casing 1 by means of bolts or the like. A shielding plate 18 that closes a bearing chamber 17 is mounted on an end of the discharge casing 3.

Figure 5:
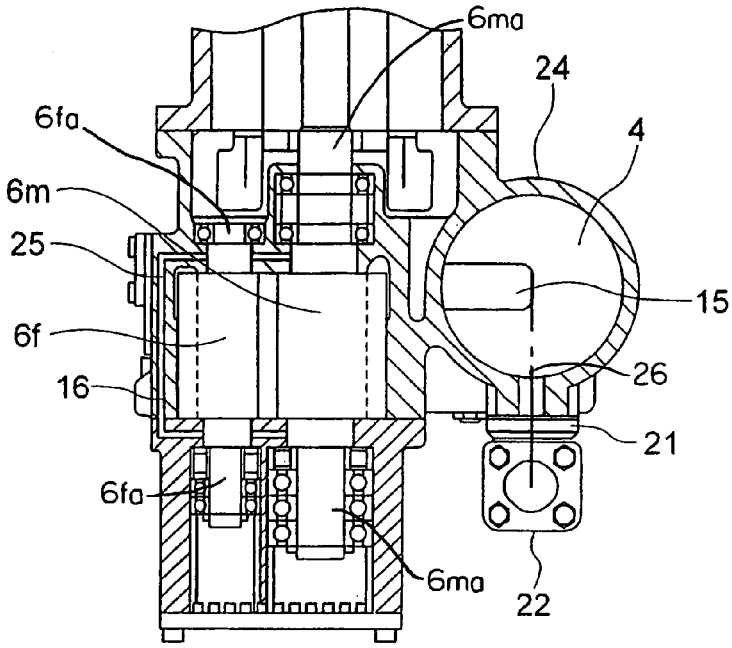
FIG. 5 is a horizontal, cross sectional view showing the screw compressor shown in FIG. 1.

As shown in FIG. 5, oil feed passages 25 are formed in the main casing 1 and the discharge casing 3 to provide communication between the oil reservoir 19 and respective bearing portions.

The oil separation space 4 formed in the oil separator 24 has a cross section having a circular shape or an approximate circular shape, and is provided centrally thereof with an inner cylinder 5 such as pipe.

Flows of refrigerant gas and oil will be described hereinafter.

Refrigerant gas of low temperature and low pressure sucked from the suction inlet 8 provided on the motor casing 2 passes through a gas passage formed between the drive motor 7 and the motor casing 2, and an air gap defined between a stator and a motor rotor, cools the drive motor 7, and thereafter is drawn through the suction port 9 formed on the main casing 1 into a compression chamber defined by meshing tooth surfaces of the male and female screw rotors and the cylindrical-shaped bore 16. As the male rotor 6*m* directly connected to the drive motor 7 rotates, the refrigerant gas is introduced into the compression chamber and gradually compressed as the compression chamber is reduced in volume. Thus the refrigerant gas becomes one of high temperature and high pressure to be discharged into a discharge port 14 provided in the discharge casing 3, from which discharge port the refrigerant gas passes through a discharge gas passage 20 that is formed in the discharge casing 3 and the main casing 1, and is discharged into the oil separation space 4 of the oil separator 24. Among compression reaction forces acting on the male and female screw rotors at the time of compression, a radial load is borne by the bearings 10, 11, 12 and a thrust load is borne by the ball bearing 13. Oil for lubrication and cooling of these bearings is fed due to a differential pressure through the oil feed passages 25 that are formed to be communicated with the respective bearing portions, from the oil reservoir 19 formed below a compression mechanism composed of the male and female screw rotors, and the oil thus fed is then discharged together with the compressed gas into the oil separation space 4.

An inlet portion 20*a* of the discharge gas passage 20 is opened substantially tangentially to an inner wall of the oil separation space 4, and a mixture of the compressed gas (refrigerant) and the oil inflows along the oil separator inner wall to go along the cylindrical-shaped inner wall to generate a swirling flow, and the oil is separated from the gas due to the centrifugal action. The oil as separated drops along the wall surface, passes through the opening 15 that provides communication between the oil separation space 4 and the oil reservoir 19 in the compressor, and is accumulated in the oil reservoir 19. By forming the opening 15 into, for example, a rectangular shape shown in FIG. 3, manufacture as by casting or the like is facilitated.

If a constitution, in which the oil is accumulated in the oil separation space 4, is employed, a spatial distance above an oil surface is reduced and so the oil separated by the swirling flow generated within the oil separation space 4 is again carried away together with the gas to cause scattering again. According to the embodiment, the oil as separated is recovered into the oil reservoir 19 through the opening 15 formed in a part of a lower portion of the oil separation space 4, so that it is possible to prevent carrying-away by the swirling flow of the gas within the oil separation space 4.

In addition, the compressed refrigerant gas after the oil separation is discharged outside the compressor via a discharge port 23.

According to the embodiment, the oil separator is formed integral with the main casing, so that the discharge casing can be sharply reduced in weight as compared with the case where the oil separator were formed integral with the discharge casing. Therefore, the oil separator is formed integral with the compressor casing, that is, the oil separation mechanism is not provided separately from the compressor body, and so it suffices that the discharge casing reduced in weight be dismounted at the time of the maintenance operation such as exchange of bearings or the like, thus enabling markedly enhancing the work efficiency.

Figure 4:
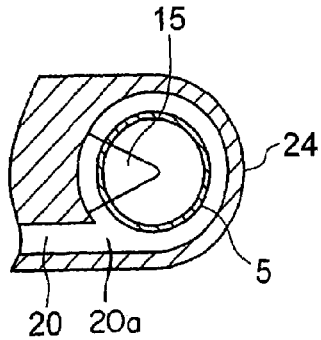
FIG. 4 is a view corresponding to FIG. 3 and showing another example of an opening.

FIG. 4 is a view corresponding to FIG. 3, and shows another example of a shape of the opening 15 formed in the lower portion of the oil separator. In this example, the opening 15 is shaped to assume a sector such that its width, that is, its opening area is increased as it approaches an outer wall side of the oil separation space from a center thereof. With such construction, much of the oil moves to an outer peripheral side of the oil separation space 4 due to centrifugal forces generated by the swirling flow, so that there is produced an effect that the oil can be rapidly and efficiently recovered into the oil reserving space when the opening area of the opening is increased toward the outer periphery of the oil separation space. In addition, the openings 15 may be provided in plural number.

Figure 6:
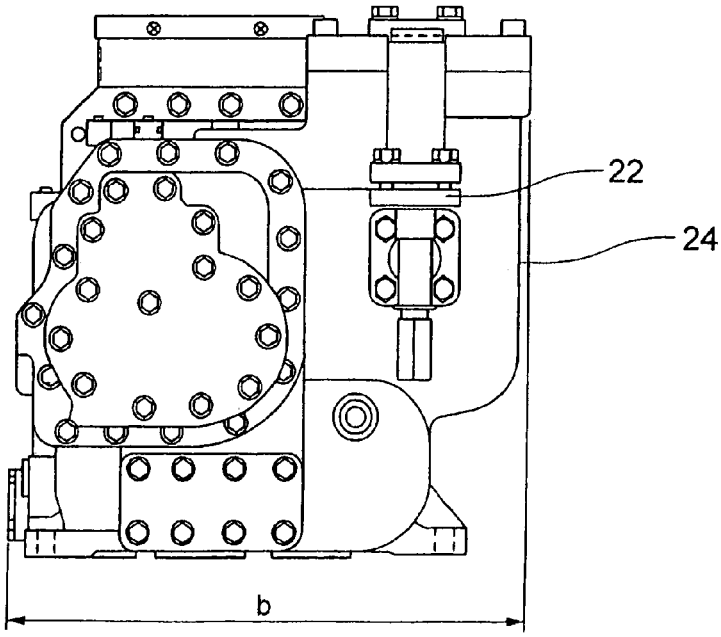
FIG. 6 is a view (side view) of the screw compressor as viewed along an arrow B shown in FIG. 1.

FIG. 5 is a horizontal, cross sectional view showing the screw compressor shown in FIG. 1, and FIG. 6 is a view as viewed along an arrow B in FIG. 1.

The oil separator 24 is provided with a mount hole 21, to which a safety valve 22 is mounted, and a line 26 connecting between a center of the oil separator 24 and the mount hole 21 is made substantially in parallel to axes 6*ma* , 6*fa* of the screw rotors 6*m,* 6*f.* The safety valve 22 is communicated with the discharge gas passage 20 through the mount hole 21 and the oil separation space 4. With such construction, even when the safety valve 22 is mounted, a depth dimension b (see FIG. 6) is not increased, and so an installation area (a length dimension a×depth dimension b) of the compressor can be made minimum.

While a construction has been described, in which the oil separator 24 and the oil reserving space 19 are formed integral with the main casing of the screw compressor in the above embodiment, an oil separator and an oil tank (oil reservoir) can be formed separately to be mounted or arranged on a front surface or a back surface of a main casing.

According to the invention, since the oil separator and the oil reservoir are formed integral with the casing that accommodates therein the rotors, the discharge casing is made separate from the oil separator and the oil reservoir and so can be sharply reduced in weight, whereby it is possible to easily perform the maintenance work such as inspection, repair, and exchange of bearings, etc.

Also, since the opening that provides communication between the lower portion of the oil separator and the oil reservoir is provided on a part of the bottom of the oil separation space, accumulation of the oil in the oil separation space is eliminated and it is possible to prevent the gas swirling flow in the oil separation space from flinging up the oil accumulated in the oil reservoir, so that the oil as separated can be prevented from being again mixed in the discharged gas. Therefore, it becomes unnecessary to ensure a large spatial distance above the oil surface as in the conventional art, so that the compressor can be made small in size. Further, such a part as mesh wire pad as in the conventional art becomes unnecessary, and so the compressor is made simple in construction.

With the opening having a cross sectional area such that a width (area) of the opening is increased as it approaches the outer peripheral side of the oil separation space from the center thereof, the oil separated in the oil separation space can be efficiently recovered in the oil reservoir and so a screw compressor having a small oil flow-off quantity is obtained.

Further, a line connecting between the safety valve and the center of the oil separator is made substantially in parallel to the axes of the screw rotors whereby there is produced an effect that the screw compressor can be reduced in installation area.

What is claimed is:

1. A screw compressor comprising a casing accommodating therein at least a pair of male and female rotors meshing with each other and bearings, a discharge casing including bearings that support the male and female rotors, a substantially cylindrical-shaped, vertical oil separator, and an oil reservoir that accumulates therein an oil separated by the oil separator, and wherein the oil separator and the oil reservoir are formed integral with the casing, wherein a safety valve communicated with a discharge gas passage of the compressor is mounted on an outer wall of the oil separator and a line connecting between the safety valve and a center of the oil separator is made substantially in parallel to axes of the screw rotors.

2. A screw compressor according to claim 1, wherein an inner space in the oil separator and the oil reservoir are communicated to each other by at least one or more openings.

3. A screw compressor according to claim 2, wherein the opening or openings are provided at a lower end of the oil separator or in the vicinity of the lower end.

4. A screw compressor according to claim 3, wherein the opening or openings are formed so that a width thereof is increased toward an outer peripheral side of the inner space of the oil separator from a center thereof.

5. A screw compressor comprising a main casing accommodating therein a pair of male and female rotors meshing with each other, bearings and the like, a discharge casing including bearings that support the rotors, an oil separator, and an oil reservoir that accumulates therein an oil separated by the oil separator, and wherein the oil separator and the oil reservoir are formed integral with the main casing, an inner space in the oil separator and the oil reservoir are communicated with each other by at least one or more openings, a safety valve is mounted on the oil separator, and a line connecting between the safety valve and a center of the oil separator is made substantially in parallel to axes of the screw rotors.

6. A screw compressor according to claim 5, wherein the opening or openings define a part of a lower portion of an oil separation space of the oil separator and are formed toward an outer peripheral side of the inner space of the oil separator from a center thereof.

* * * * *